United States Patent [19]

Clark et al.

[11] Patent Number: 4,961,568

[45] Date of Patent: Oct. 9, 1990

[54] EXERCISING AND STRETCHING A PERSON'S FINGER JOINTS

[75] Inventors: Douglas W. Clark, P.O. Box 96952, Las Vegas, Nev. 89193; Steven Zabel, Las Vegas, Nev.

[73] Assignee: Douglas W. Clark, Las Vegas, Nev.

[21] Appl. No.: 332,725

[22] Filed: Apr. 4, 1989

[51] Int. Cl.[5] ..... A63B 21/07

[52] U.S. Cl. ..... 272/68; 273/26 R

[58] Field of Search ..... 434/247; 258, 260; 128/26, 77; 272/67, 68, 116, 137, 143, 93; 273/26 R, 26 D; 84/470 R

[56] References Cited

U.S. PATENT DOCUMENTS

| | | | |
|---|---|---|---|
| 623,235 | 4/1899 | Crane | 272/67 |
| 2,271,164 | 1/1942 | Sullivan | 272/68 |
| 3,189,025 | 6/1965 | Yaklin | 128/26 |
| 4,730,827 | 3/1988 | Williams | 272/67 X |

FOREIGN PATENT DOCUMENTS

| | | | |
|---|---|---|---|
| 606599 | 6/1926 | France | 128/26 |
| 246326 | 1/1926 | United Kingdom | 272/67 |

*Primary Examiner*—Richard J. Apley
*Assistant Examiner*—H. N. Flaxman
*Attorney, Agent, or Firm*—James F. Duffy

[57] ABSTRACT

An apparatus which permits the index and middle finger of the hand to be spread apart in a manner to stress the finger joints. The joint may then be exercised while in its stressed condition so that the joint is strengthened at the same time as it is made more flexible. The object of the invention is to improve the flexibility and stretch of the finger muscles of the index and middle finger of the hand so that a person utilizing the exerciser may practice the split finger baseball pitch.

3 Claims, 1 Drawing Sheet

FIG. 1
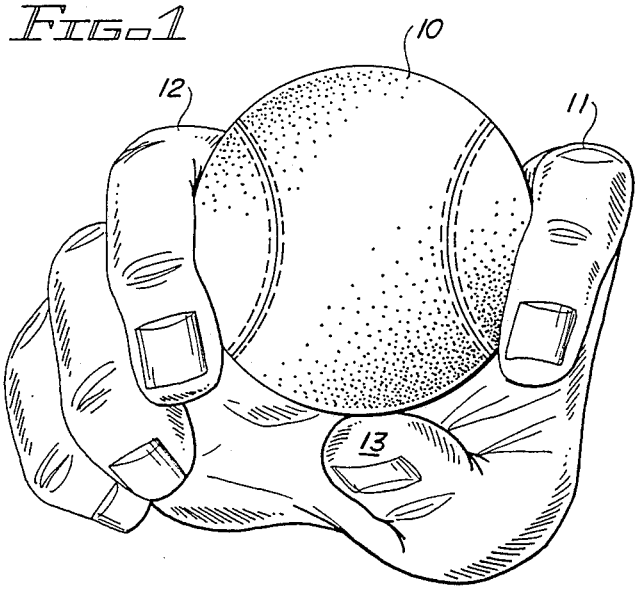
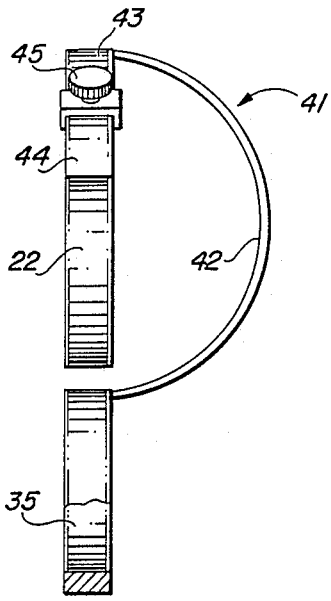
FIG. 5
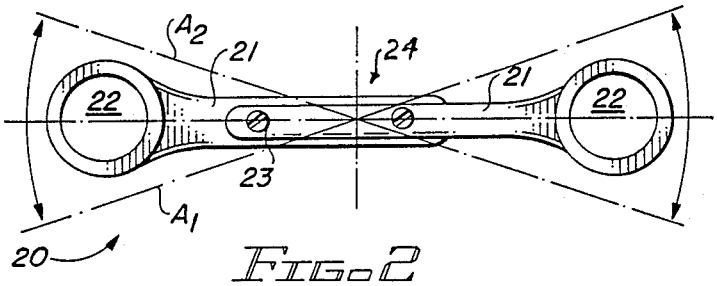
FIG. 2
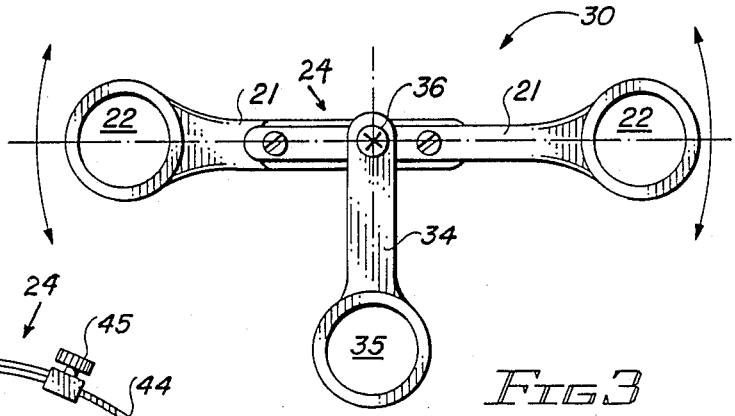
FIG 3
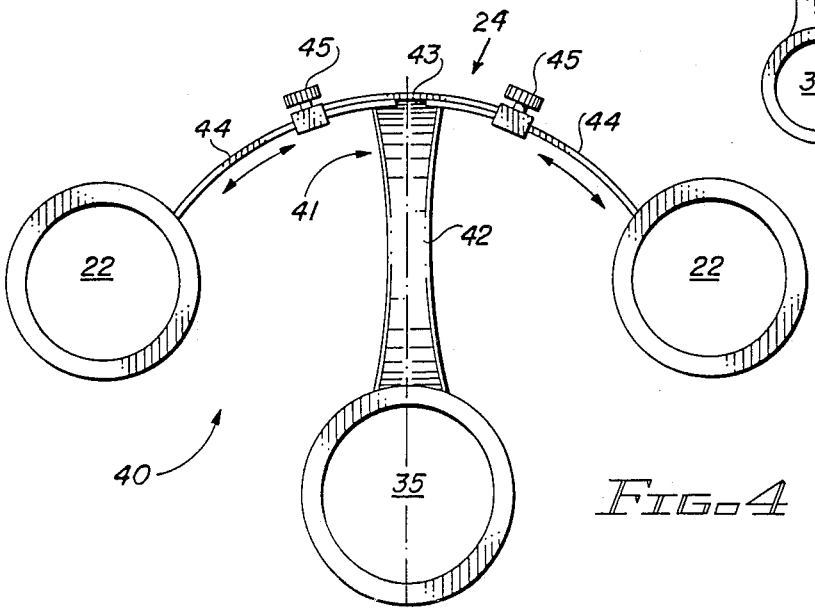
FIG. 4

EXERCISING AND STRETCHING A PERSON'S FINGER JOINTS

BACKGROUND

1. Field of the Invention

The invention relates to the field of apparatus wherein joints are exercised and tendons lengthened. In particular, the invention relates to apparatus for stretching the tendons between the index finger and the middle finger of a person's hand and exercising and increasing the joint between the fingers so as to strengthen the finger muscles, increase the suppleness and permit a person greater facility in pitching a baseball using the pitch known as the "split finger pitch."

2. Prior Art

Musicians who play keyboard instruments have resorted to various types of exercise devices to increase the spread of their extended and separated fingers. These devices generally captivate the fingers and spread them apart, one from the other. The manner in which these devices work tends to impose severe limitations on flexing of the fingers while the fingers are spread apart.

No finger exercise device is known which spreads apart the index and middle finger of the hand, stressing the joint so as to elongate it, and permitting the fingers to be flexed so as to exercise the finger muscles and increase the suppleness of the stressed joint. Further, no prior art device is known which permits the stressing of the joint between index and middle finger, the flexed exercise of the fingers while in separated condition, and the general maintenance of the thumb in a triangular relationship with positions of the index and middle finger during the course of the exercises.

SUMMARY OF THE INVENTION

The invention consists of apparatus for exercising and stretching a person's finger joints. There are two finger receptacles for receiving the index and middle fingers, adjacent the ends of the fingers. Between the finger receptacles is a finger separation bridge which couples the two receptacles in a manner so as not to interfere with the flexure of the knuckle and middle joints of a person's fingers when the device is in use.

In a presently preferred embodiment of the invention the separation bridge which couples the finger receptacles is made adjustable so that the degree of separation of the two fingers may be established and extended over a period of time. A third receptacle is coupled to the separation bridge and is intended to receive the thumb of a person utilizing the device. The three receptacles preferably lie in the same plane in a generally triangular relationship. With thumb, index and middle finger inserted in their respective receptacles, a person may flex and exercise his spread fingers while maintaining the thumb in a position generally between and below the fingers being exercised.

In a first presently preferred embodiment of the invention, the thumb receptacle is rotatably coupled to the finger separation bridge. This permits a person who is using the apparatus to flex and exercise his fingers while varying their spacial relationship with the thumb.

In an alternative, preferred embodiment, the finger separation bridge itself is comprised of flexible elements. The ability to flex the bridge permits a person using the device to flex and exercise his fingers, such that the finger joints are stretched when the fingers are flexed away from the thumb, and the joints relaxed when the fingers are flexed toward the thumb.

DESCRIPTION OF THE DRAWINGS

FIG. 1 suggests the manner in which a baseball is held in the hand for the "split finger pitch."

FIG. 2 illustrates the device for stretch-separating two fingers while permitting the fingers to be flexed and exercised.

FIG. 3 adds a thumb receptacle, rotatably coupled to the exercise device of FIG. 2.

FIG. 4 is a finger stretching/exercising device in which the elements employed for separating the fingers are flexible.

FIG. 5 is a side view of the exercise device of FIG. 4.

A DETAILED DESCRIPTION OF THE INVENTION

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The illustration of FIG. 1 suggests the manner in which a baseball 10 is disposed between the middle joints of index finger 11 and middle finger 12 and stabilized by the thumb 13. The drawing is for illustrative purposes only and may not represent the precise placement of the ball between the fingers. Few persons can separate fingers 11 and 12 so as to captivate the baseball 10 between them and still control the ball when pitching it. It is the object of the invention to enable a person to stretch and exercise the finger joints so that the fingers may be spread to accept the ball and there will be strength enough in the fingers to carry the ball and transport it controllably through the pitch.

A device which will stretch the fingers wide apart while allowing the fingers to flex in that stressed position is illustrated in FIG. 2. The finger exercise device 20 is comprised of two finger receptacles 22 coupled together by a finger separation bridge 24. Bridge 24 is comprised of two slide adjustable shafts 21. Shafts 21 may be adjusted to set the spread of finger receptacles 22 and the spread then fixed by locking adjustment devices 23.

In using exercise device FIG. 2, a person would adjust the spacing of finger receptacles 22 so as to stress the finger joints of his hand. Locking devices 23 would be locked down so as to maintain the receptacles 22 in the extended position. A person would insert his index and middle fingers into the respective receptacles 22 and, while the fingers are so stressed by spreading apart, he would wiggle the fingers in a manner indicated by the arrows in FIG. 2 such that the fingers when disposed at either extreme of their travel would define a line A1 or A2. This up and down motion of the two fingers while stressedly separated strengthens the finger muscles and adds flexibility to the finger joints.

While a person using exercise device 20 may well attempt to position the thumb in the position required to throw the split finger pitch baseball as illustrated in FIG. 1, it is preferred to have a receptacle for the thumb as well. This arrangement is shown in FIG. 3. Thumb receptacle 35 has its extension shaft 34 rotatingly coupled to finger separation bridge 24 by pin 36. Now when the index and middle fingers are inserted into receptacles 22 and the thumb is inserted into receptacle 35, the two fingers which are stressed and being spread apart by the separation of receptacles 22 are free to flex in the manner discussed with respect to FIG. 2 while the thumb remains positioned, in receptacle 35, between and below the positions of the index and middle fingers which are captivated within receptacles 22. Thus, the exercise proceeds while the thumb is maintained in its generally proper position for tossing a baseball using the split finger pitch illustrated in FIG. 1.

Additional benefit may be derived by employing flexible elements in the assembly of finger separation bridge 24. This concept is illustrated in FIG. 4. In a manner analogous to the exercise device 30 of FIG. 3, exerciser 40 of FIG. 4 is comprised of a pair of finger receptacles 22 coupled together by an adjustable finger separation bridge 24 and having a thumb receptacle 35 also coupled to bridge 24. As seen in FIG. 5, a side view of FIG. 4, finger receptacles 22 and adjustable finger separation bridge 24 lie in the same plane. Thumb receptacle 35 is coupled to bridge 24 by means of a curved shaft 42. Shaft 42 places thumb receptacle 35 in the same plane, generally, as that in which finger receptacles 22 lie. As the drawings illustrate, it is preferred that thumb receptacle 35 and finger receptacles 22 shall all lie in the same plane. Finger separation bridge 24 is itself comprised of two flexible elements 44 which are slide coupled to fixed bridge element 43 by means of slide coupling/lock screws 45.

Note the manner in which the flexible elements 44 contribute to the beneficial exercise flexure of the fingers captivated within receptacles 22. When either receptacle 22 is flexed upward or downward it tends to spiral about a center of rotation approximately that of the intersection of the center line of shaft 42 and its intersection with fixed bridge element 43. Thus, as each of the two receptacles 22 is drawn downward by the fingers being flexed downward, the fingers, captivated by receptacles 22, tend to draw closer together as they move downward towards the thumb retained in receptacle 35. Conversely, as the fingers are moved upward within receptacles 22 and away from the thumb in receptacle 35 the two fingers are spread further apart. Moving one finger up and the other finger down results in a stretching of the joint of one finger and a relaxation of the joint of the other. The combination of stress-stretching and relaxation of the finger joints obtainable by use of the exerciser 40 of FIG. 4 and FIG. 5 both supplements and complements the exercise available with either exerciser 20 of FIG. 2 or exerciser 30 of FIG. 3.

What has been disclosed is an apparatus which permits the index and middle finger of the hand to be spread apart in a manner to stress the finger joints. The joint may then be exercised while in its stressed condition so that the joint is strengthened at the same time as it is made more flexible. The object of the invention is to improve the flexibility and stretch of the finger muscles of the index and middle finger of the hand so that a person utilizing the exerciser may practice the split finger baseball pitch.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. Apparatus for exercising and stretching a person's finger joints comprising:
   - a first finger receptacle;
   - a second finger receptacle;
   - a thumb receptacle,
   - all said receptacles lying generally in a plane,
   - a length adjustable, flexible, finger separation bridge coupling said first and said second finger receptacle, lying in said plane with said receptacles, and permitting flexure of the joints of a person's fingers when received by said receptacles;
   - a shaft coupling said thumb receptacle centrally to said length adjustable, flexible, finger separation bridge for positioning a person's thumb generally between a person's fingers when the thumb and fingers are inserted in the respective receptacles of the apparatus, said first and second finger receptacles and said thumb receptacles being positioned in a generally triangular relationship with one of said receptacles at each apex of the triangle so defined.

2. The apparatus of claim 1 wherein said shaft coupling said thumb receptacle to said finger separation bridge is coupled to said finger separation bridge by rotary coupling means for rotating said first and said second finger receptacles thereabout and permitting a person using the apparatus to flex and exercise his fingers and vary their spacial relationshipwith his thumb.

3. The apparatus of claim 1 wherein said flexible finger separation bridge is non-rotatingly coupled to said shaft coupling said thumb receptacle and said bridge thereby permitting a person using the apparatus to flex and exercise his fingers, stretching the finger joints as the fingers are flexed away from the thumb and relaxing the finger joins when the fingers are flexed toward the thumb, the non-rotating coupling of the shaft to said bridge requiring each finger to spiral about the point at which said shaft is coupled to said bridge as each finger is moved.

* * * * *